US011885546B1

(12) United States Patent
Stewart

(10) Patent No.: US 11,885,546 B1
(45) Date of Patent: Jan. 30, 2024

(54) CONTROL PROCESS FOR CLIMATE CONTROL SYSTEM BASED ON OUTDOOR HUMIDITY CONDITIONS

(71) Applicant: Trane International Inc., Davidson, NC (US)

(72) Inventor: Jeffrey L. Stewart, Whitehouse, TX (US)

(73) Assignee: Trane International Inc., Davidson, NC (US)

( * ) Notice: Subject to any disclaimer, the term of this patent is extended or adjusted under 35 U.S.C. 154(b) by 0 days.

(21) Appl. No.: 17/807,834

(22) Filed: Jun. 20, 2022

(51) Int. Cl.
*F25B 49/02* (2006.01)
*F24F 1/06* (2011.01)
*F24F 110/22* (2018.01)

(52) U.S. Cl.
CPC ..... *F25B 49/022* (2013.01); *F24F 1/06* (2013.01); *F24F 2110/22* (2018.01); *F25B 2600/025* (2013.01); *F25B 2600/111* (2013.01); *F25B 2700/1933* (2013.01)

(58) Field of Classification Search
CPC ..... F25B 49/022; F25B 2600/025; F25B 2600/111; F25B 2700/02; F25B 2700/1933; F24F 1/06; F24F 2110/20; F24F 2110/22
See application file for complete search history.

(56) References Cited

U.S. PATENT DOCUMENTS 7,975,495 B2 7/2011 Voorhis et al.
10,866,002 B2 12/2020 Taras et al.
10,955,164 B2 3/2021 Klein et al.
11,035,585 B2 6/2021 Ram
2008/0190121 A1 8/2008 Backman et al.
2012/0053738 A1 3/2012 Lingrey et al.
2016/0047595 A1* 2/2016 Williams ..... F25B 49/02 62/62

(Continued)

FOREIGN PATENT DOCUMENTS

EP 2 623 880 B1 9/2020

OTHER PUBLICATIONS

WO 2021/223531 (English Translation) (Year: 2021).*

(Continued)

*Primary Examiner* — Jonathan Bradford
(74) *Attorney, Agent, or Firm* — WOMBLE BOND DICKINSON (US) LLP

(57) ABSTRACT

Examples of the present disclosure relate to climate control systems and outdoor units that use humidity measurements associated with the outdoor environment to improve the operation of one or more components. In some examples, an outdoor unit of a climate control system includes a housing, a compressor located within the housing that circulate a refrigerant fluid, and a humidity sensor that detects a humidity condition of an outdoor environment. The outdoor unit may further include control circuitry that controls the compressor by establishing a target parameter, where the target parameter is associated with a property of a refrigerant fluid. The control circuitry may further receive measurements associated with the humidity condition of the outdoor environment, adjust the target parameter based on the measurement, monitor the property of the refrigerant fluid, compare the monitored property to the adjusted target parameter, and adjust operation of the compressor based on the comparison.

24 Claims, 7 Drawing Sheets

(56) References Cited

U.S. PATENT DOCUMENTS

| | | | | |
|---|---|---|---|---|
| 2019/0178520 | A1 | 6/2019 | Apsangi | |
| 2020/0064033 | A1 | 2/2020 | Ostrye et al. | |
| 2021/0310668 | A1* | 10/2021 | Bruton | F24D 5/12 |
| 2021/0348817 | A1 | 11/2021 | Bates et al. | |

OTHER PUBLICATIONS

Tenwolde, A. & Walker, I. Interior Moisture Design Loads for Residences. In Buildings VIII, Whole Buildings—Principles, Dec. 2001, USA. 7 pages.

* cited by examiner

CONTROL PROCESS FOR CLIMATE CONTROL SYSTEM BASED ON OUTDOOR HUMIDITY CONDITIONS

TECHNOLOGICAL FIELD

The present disclosure relates generally to improved climate control systems that include features for controlling a climate control system based on humidity conditions of an outdoor ambient environment.

BACKGROUND

Various different climate control systems exist designed to condition a given space, typically using one or more conditioning modes. In doing so, these climate control systems satisfy a conditioning load, which often includes both a sensible conditioning load and a latent conditioning load. The sensible conditioning load is typically associated with a change in dry bulb temperature of the space. The latent load is typically associated with the humidity of the space and the load associated with reducing the humidity in a given space.

Existing climate control systems utilize various techniques for addressing sensible and latent loads, however, latent loads often represent a unique challenge because the latent load may not be represented by a standard temperature sensor for a given space. As a result, existing systems often use additional sensors to monitor the latent load of the space and/or other processes that add complexity and cost to the climate control system.

Moreover, because these existing systems typically focus on the latent load at the conditioned space, the information associated with the latent load may not be communicated to an outdoor unit. Or in other examples, the climate control system may include complex communication protocols which provides additional control information to the components of the outdoor unit, potentially driving up costs.

BRIEF SUMMARY

The present disclosure addresses the deficiencies described above and provides an improved design for a climate control system which controls one or more of the components of an outdoor unit based on humidity measurements of the outdoor ambient environment. For example, the operation of an adjustable compressor may be adjusted based on these humidity measurements, which may allow the compressor to better track the latent load handled by the climate control system. In some examples, these controls may further extend to other components, e.g. the outdoor fan.

In some of these examples, the adjustable compressor of the climate control system may be controlled based on a target parameter, e.g., saturation temperature. This target parameter may be adjusted based on measurements associated with the humidity of the outdoor ambient environment. In these examples, the humidity of the outdoor ambient environment may correlate to a latent load of the space(s) being conditioned by the climate control system. Thus, by adjusting the target parameter based on these measurements the system is better able to track the load being addressed.

The present disclosure thus includes, without limitation, the following example embodiments.

Some example implementations include a method for controlling an adjustable compressor within a climate control system, the method comprising: establishing a target parameter for controlling an operation of the adjustable compressor, the target parameter associated with a property of a refrigerant fluid circulated within a climate control system; receiving a measurement representative of a humidity condition of an outdoor ambient environment; adjusting the target parameter based on the measurement, the adjustment establishing an adjusted target parameter; monitoring the property of the refrigerant fluid; comparing the monitored property to the adjusted target parameter; and adjusting an operation of the adjustable compressor based, at least in part, on the comparison of the monitored property to the adjusted target parameter.

Some example implementations include an outdoor unit of a climate control system, the outdoor unit comprising: a housing; an adjustable compressor located within the housing and configured to circulate a refrigerant fluid through the climate control system; a humidity sensor configured to detect a measurement representative of a humidity condition of an outdoor ambient environment; and control circuitry operably coupled to the adjustable compressor and configured to: establish a target parameter for controlling an operation of the adjustable compressor, the target parameter associated with a property of a refrigerant fluid circulated within a climate control system; receive a signal indicative of the measurement associated with the humidity condition of the outdoor ambient environment from the humidity sensor; adjust the target parameter based on the measurement, the adjustment establishing an adjusted target parameter; monitor the property of the refrigerant fluid; compare the monitored property to the adjusted target parameter; and adjust an operation of the adjustable compressor based, at least in part, on the comparison of the monitored property to the adjusted target parameter.

Some example implementations include a climate control system comprising an outdoor unit including: a housing, an adjustable compressor located within the housing and configured to circulate a refrigerant fluid through the climate control system, a humidity sensor located within the housing and configured to detect a measurement representative of a humidity condition of an outdoor ambient environment, a pressure sensor coupled to the housing and configured to detect a pressure representative of the refrigerant fluid proximate an inlet to the adjustable compressor, and control circuitry located within the housing and coupled to the adjustable compressor, the humidity sensor, and the pressure sensor; and a non-communicating thermostat located outside the housing and associated with a conditioned space, wherein the control circuitry is further coupled to the non-communicating thermostat via a 24 volt (24V) communication protocol and configured to: receive a request for a cooling mode from the non-communicating thermostat via the 24V communication protocol; operate the outdoor unit in the cooling mode in response to the request; establish a target parameter for controlling an operation of the adjustable compressor, the target parameter associated with the temperature of the refrigerant fluid circulated within the climate control system; receive a signal indicative of the measurement associated with the humidity condition of the outdoor ambient environment from the humidity sensor; adjust the target parameter based on the measurement, the adjustment establishing an adjusted target parameter, monitor the temperature of the refrigerant fluid proximate the inlet to the adjustable compressor using the measurements received from the pressure sensor, compare the monitored temperature to the adjusted target parameter, and adjust an operation of the adjustable compressor based, at least in part, on the comparison of the monitored temperature to the adjusted target parameter.

These and other features, aspects, and advantages of the disclosure will be apparent from a reading of the following detailed description together with the accompanying drawings, which are briefly described below. The disclosure includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed disclosure, in any of its various aspects and embodiments, should be viewed as intended to be combinable unless the context clearly dictates otherwise.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

Figure 4A:
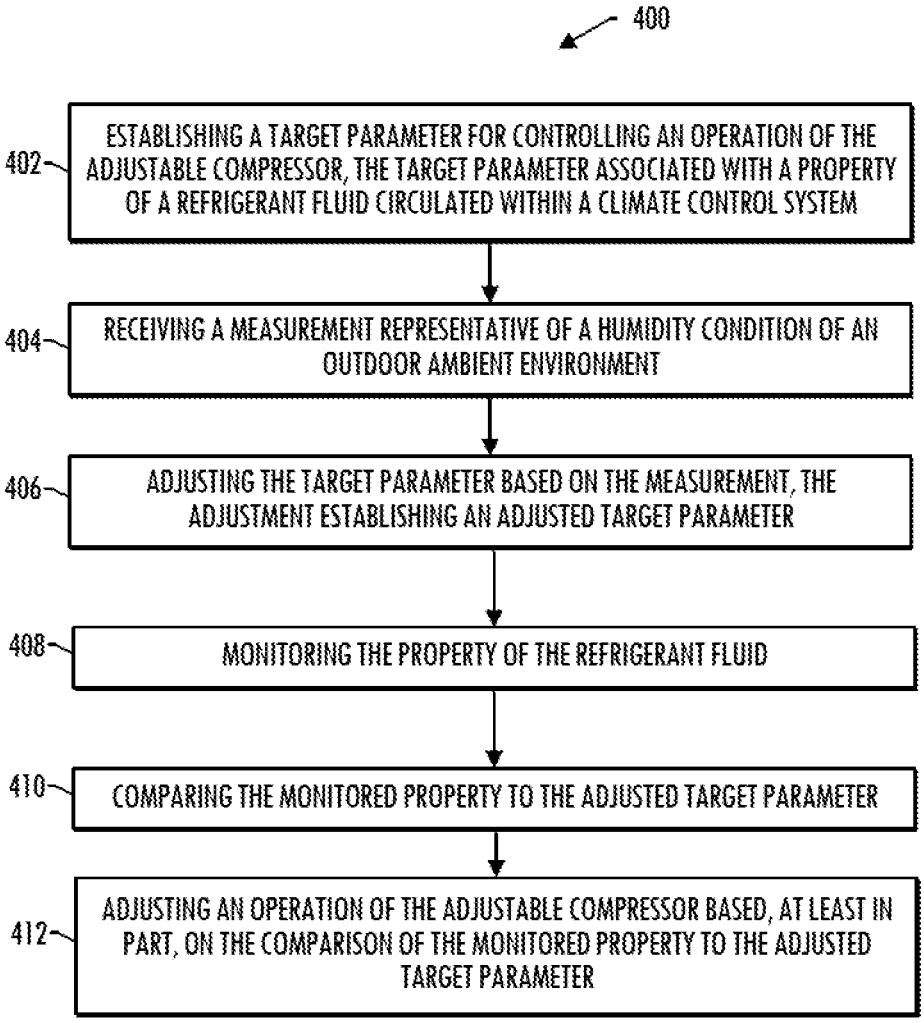
Figure 4B:
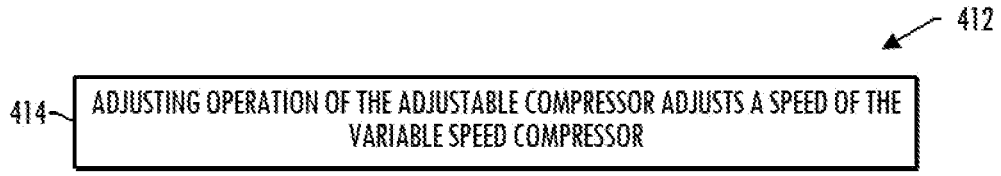
Figure 4C:
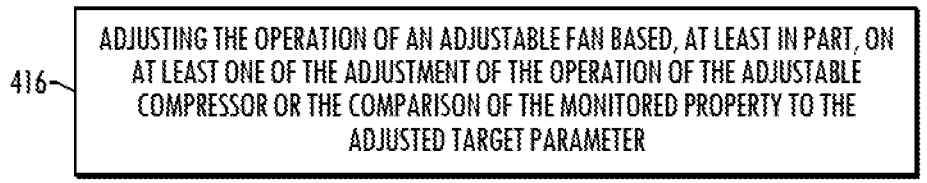
Figure 4D:
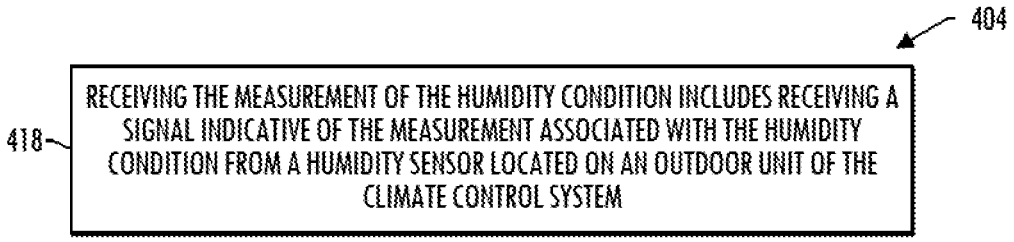
Figure 4E:
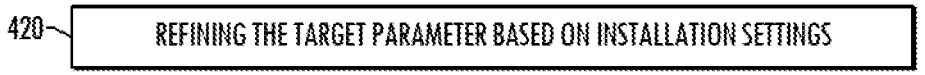
Figure 4F:
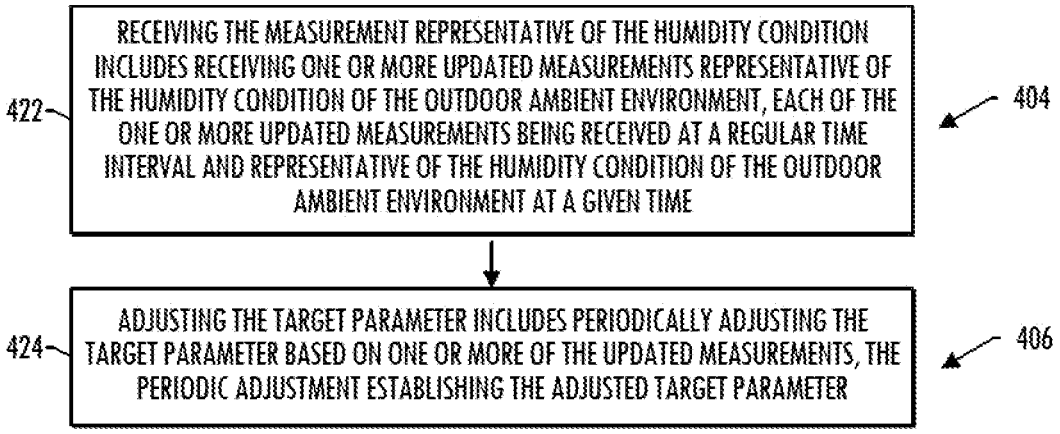
Figure 4G:
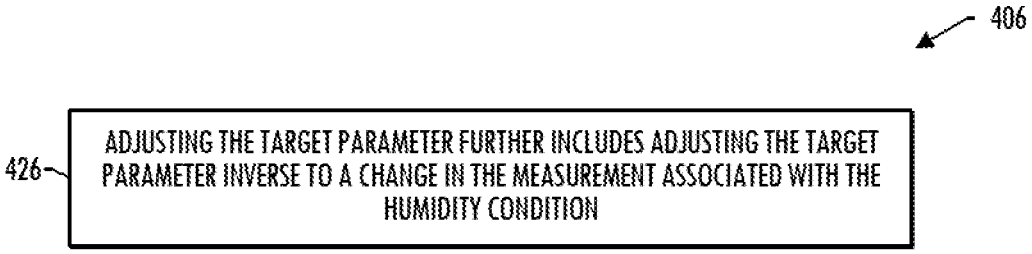
Figure 4H:
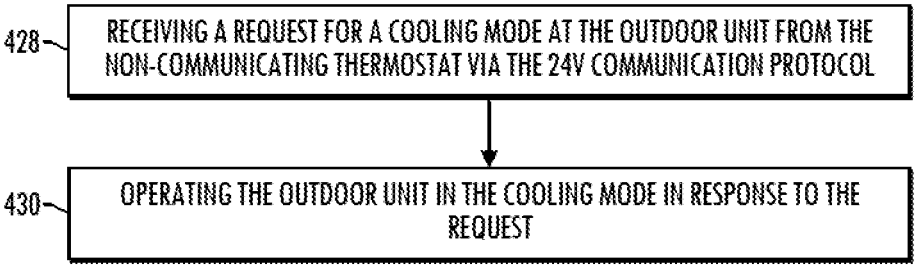
Figure 5:
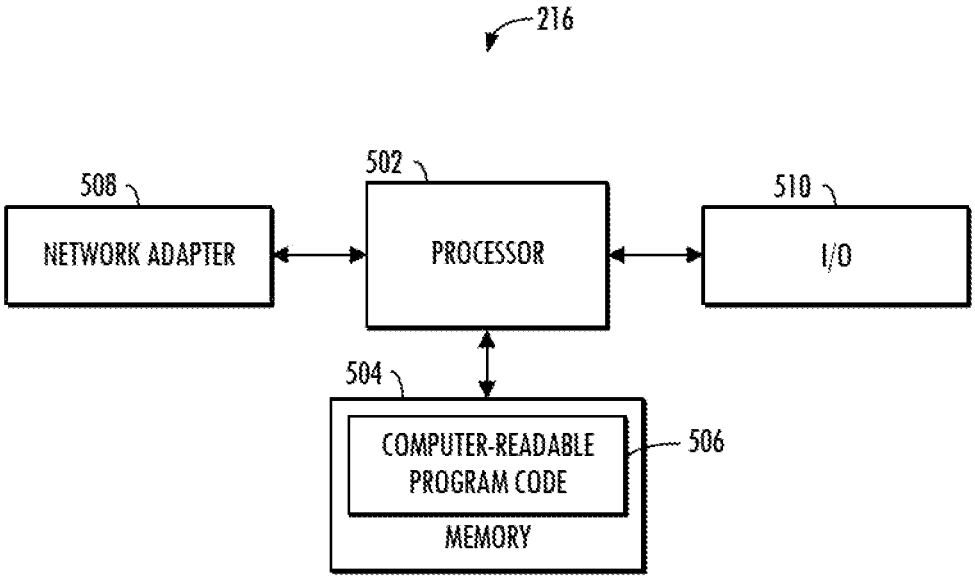

FIGS. 4A, 4B, 4C, 4D, 4E, 4F, 4G, and 4H are flowcharts illustrating various operations in a method of climate control systems, according to some example embodiments; and FIG. 5 is an illustration of control circuitry, according to an example embodiment of the present disclosure.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise, or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of embodiments of the described disclosure in the installed configuration (e.g., in an operational configuration). It is understood that such terms are not used in any absolute sense.

Example implementations of the present disclosure relate to an improved design for a climate control system which controls one or more of the components of an outdoor unit based on humidity measurements of the outdoor ambient environment. For example, the operation of an adjustable compressor may be adjusted based on these humidity measurements, which may allow the compressor to better track the latent load handled by the climate control system. In some examples, these controls may further extend to other components, e.g. an outdoor fan.

The adjustable compressor of the climate control system may be controlled based on a target parameter, e.g., saturation temperature. This target parameter may be adjusted based on measurements associated with the humidity of the outdoor ambient environment. In these examples, the humidity of the outdoor ambient environment may correlate to a latent load of space(s) being conditioned by the climate control system. Thus, by adjusting the target parameter based on these measurements the system is better able to track the load being addressed.

Some examples include an outdoor unit of a climate control system. In these examples, the outdoor unit may include a housing and an adjustable compressor located within the housing. The adjustable compressor may circulate a refrigerant fluid through the climate control system. The outdoor unit may also include a humidity sensor, which detects a measurement representative of a humidity condition of an outdoor ambient environment.

In these examples, the outdoor unit may further be coupled to control circuitry, which may be operably coupled to the adjustable compressor. The control circuitry may establish a target parameter for controlling an operation of the adjustable compressor. The target parameter may be associated with a property of a refrigerant fluid circulated within a climate control system. The control circuitry may further receive a signal indicative of the measurement associated with the humidity condition of the outdoor ambient environment from the humidity sensor. The control circuitry may also adjust the target parameter based on these humidity measurements, and this adjustment may establish an adjusted target parameter. The control circuitry may also monitor the property of the refrigerant fluid, potentially using a pressure sensor and/or a temperature sensor. The control circuitry may also compare the monitored property to the adjusted target parameter. And in some examples, the control circuitry adjusts the operation of the adjustable compressor based, at least in part, on the comparison of the monitored property to the adjusted target parameter.

Figure 1:
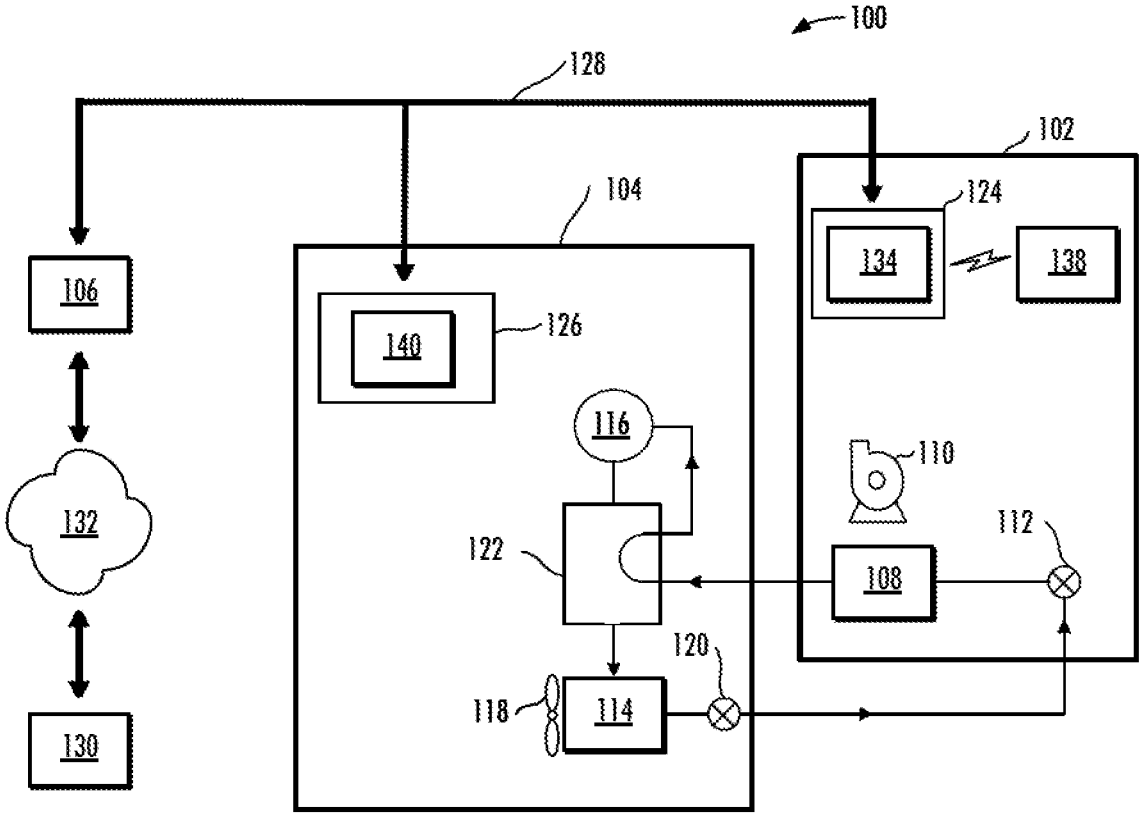
FIG. 1 is a schematic of a climate control system, according to an example embodiment of the present disclosure.

FIG. 1 shows a schematic diagram of a typical climate control system 100. In some embodiments, the climate control system 100 comprises a heat pump system that may be selectively operated to implement one or more substantially closed thermodynamic refrigerant cycles to provide a cooling functionality (hereinafter a "cooling mode") and/or a heating functionality (hereinafter a "heating mode"). The embodiments depicted in FIG. 1 is configured in a cooling mode. The climate control system 100, in some embodiments is configured as a split system heat pump system, and generally comprises an indoor unit 102, an outdoor unit 104, and a system controller 106 that may generally control operation of the indoor unit 102 and/or the outdoor unit 104.

Indoor unit 102 generally comprises an indoor air handling unit comprising an indoor heat exchanger 108, an indoor fan 110, an indoor metering device 112, and an indoor controller 124. The indoor heat exchanger 108 may generally be configured to promote heat exchange between a refrigerant fluid carried within internal tubing of the indoor heat exchanger 108 and an airflow that may contact the indoor heat exchanger 108 but that is segregated from the refrigerant fluid.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device.

Outdoor unit 104 generally comprises an outdoor heat exchanger 114, a compressor 116, an outdoor fan 118, an outdoor metering device 120, a switch over valve 122, and an outdoor controller 126. The outdoor heat exchanger 114 may generally be configured to promote heat transfer between a refrigerant fluid carried within internal passages of the outdoor heat exchanger 114 and an airflow that contacts the outdoor heat exchanger 114 but is segregated from the refrigerant fluid.

The outdoor metering device 120 may generally comprise a thermostatic expansion valve. In some examples, however, the outdoor metering device 120 may comprise an electronically-controlled motor driven EEV similar to indoor metering device 112, a capillary tube assembly, and/or any other suitable metering device.

In some examples, the switch over valve 122 may generally comprise a four-way reversing valve. The switch over valve 122 may also comprise an electrical solenoid, relay, and/or other device configured to selectively move a component of the switch over valve 122 between operational positions to alter the flow path of refrigerant fluid through the switch over valve 122 and consequently the climate control 100. Additionally, the switch over valve 122 may also be selectively controlled by the system controller 106, an outdoor controller 126, and/or the indoor controller 124.

The system controller 106 may generally be configured to selectively communicate with the indoor controller 124 of the indoor unit 102, the outdoor controller 126 of the outdoor unit 104, and/or other components of the climate control system 100. In some embodiments, the system controller 106 may be configured to control operation of the indoor unit 102, and/or the outdoor unit 104. In some embodiments, the system controller 106 may be configured to monitor and/or communicate with a plurality of temperature sensors associated with components of the indoor unit 102, the outdoor unit 104, and/or the outdoor ambient temperature. Additionally, in some embodiments, the system controller 106 may comprise a temperature sensor and/or may further be configured to control heating and/or cooling of conditioned spaces or zones associated with the climate control system 100. In other embodiments, the system controller 106 may be configured as a thermostat for controlling the supply of conditioned air to zones associated with the climate control system 100, and in some embodiments, the thermostat includes a temperature sensor.

The system controller 106 may also generally comprise an input/output (I/O) unit (e.g., a graphical user interface, a touchscreen interface, or the like) for displaying information and for receiving user inputs. The system controller 106 may display information related to the operation of the climate control system 100 and may receive user inputs related to operation of the climate control system 100. However, the system controller 106 may further be operable to display information and receive user inputs tangentially related and/or unrelated to operation of the climate control system 100. In some embodiments, the system controller 106 may not comprise a display and may derive all information from inputs that come from remote sensors and remote configuration tools.

In some examples, the system controller 106 may be configured for selective bidirectional communication over a communication bus 128, which may utilize any type of communication network. In some examples, all or portions of the communication bus 128 may comprise a 24 volt (24V) connection that uses a 24V communication protocol, and in some of these examples, the 24V connection may be unidirectional. For example, in some of these examples, the system controller may be connected to the outdoor controller 124 via a 24V connection, and the communication protocol over the 24V connection to the outdoor controller may be only an on/off signal from the system controller. In some examples, the communication from the system controller to the outdoor may be only a call for heating or a call for cooling without any additional information.

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication. In some embodiments, the indoor controller 124 may be configured to communicate with an indoor personality module 134 that may comprise information related to the identification and/or operation of the indoor unit 102.

The indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108.

The outdoor controller 126 may be carried by the outdoor unit 104 and may be configured to receive information inputs from the system controller 106, which may be a thermostat. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116.

Figure 2:
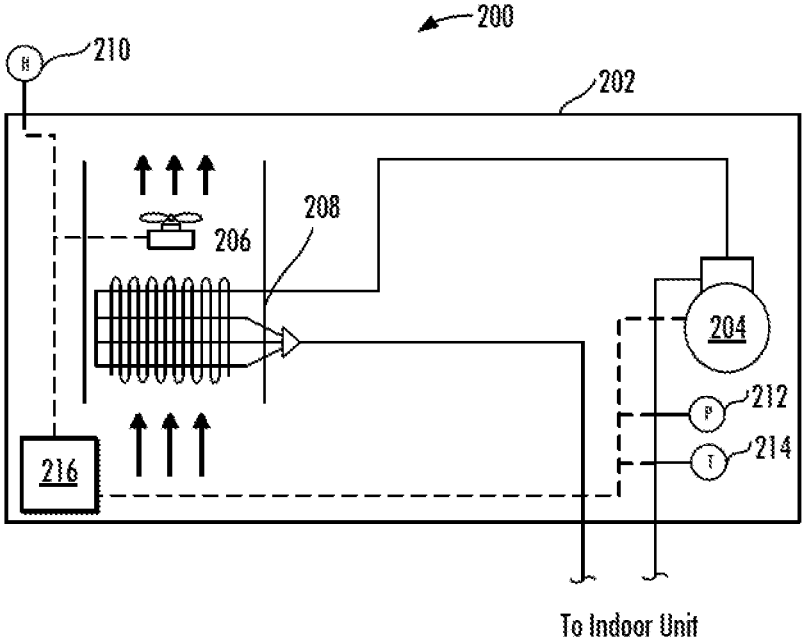
FIG. 2 is a schematic of an outdoor unit, according to an example embodiment of the present disclosure.

FIG. 2 provides an example depiction of an outdoor unit 200 that may be used with the climate control system 100. In some examples, outdoor unit 200 is the same or substantially the same as outdoor unit 104 discussed above. As shown, the outdoor unit includes a housing 202, an adjustable compressor 204, an adjustable fan 206, a heat exchanger 208, a humidity sensor 210, a temperature sensor 212, and a pressure sensor 214. In this example, the outdoor unit further includes control circuitry 216. In the depicted example these components are all included within the housing, however, in other examples some of these components may be located outside the housing. Other examples may include outdoor units with some or all of these components, along with other features.

The adjustable compressor 204 may be any variable speed type of compressor used in climate control systems. The adjustable compressor may circulate refrigerant fluid through the climate control system, and in some examples, the adjustable compressor is the same or substantially similar to compressor 116. In some examples, the adjustable compressor is a variable capacity compressor. In some examples, the adjustable compressor is a variable speed compressor, for example, the compressor motor may be controlled by a variable speed drive (VFD). Other compressors and/or configurations may be used.

The adjustable fan 206 may be any fan or blower used in climate control systems. The adjustable fan may circulate ambient air through the outdoor unit, potentially routing air through the outdoor heat exchanger 208, and in some examples, the adjustable fan may be the same or substantially similar to outdoor fan 114. In some examples, the adjustable fan is a variable speed fan, for example, the fan motor is controlled by a variable speed drive. In some examples, the adjustable fan is a staged fan, potentially including multiple stages to adjust the flow of air. Other fans and/or configurations may be used.

The depicted example in FIG. 2 also includes various sensors associated with the outdoor unit 200. In this example, the outdoor unit includes a humidity sensor 210, a temperature sensor 212, and a pressure sensor 214. In this example, each of the sensors is operably coupled to the control circuitry 216. Other examples may include other sensor configurations, e.g., less sensors, multiple of sensors, other types of sensors, etc.

The humidity sensor 210 may detect a measurement that is representative of a humidity condition of an outdoor ambient environment. This humidity sensor may be any conventional humidity sensor, e.g., capacitive sensors, resistive sensors, thermal sensors, etc. In some examples, the humidity sensor detects the humidity condition in the outdoor ambient environment, e.g., the outdoor environment in which the climate control system 100 operations. The humidity condition may be any condition indicative of the humidity of the outdoor ambient environment. In some examples, the humidity condition is either a dew point or a humidity ratio of the air of the outdoor ambient environment. These humidity condition measurements are generally preferred because they provide an absolute measurement for the humidity, however, in some examples other forms of humidity conditions are measured, e.g., wet bulb temperature, relative humidity, etc.

The example depicted in FIG. 2 also includes a temperature sensor 212 and a pressure sensor 214 both coupled to the refrigerant circuit in the outdoor unit 200. These sensors may be used to monitor a property of the refrigerant fluid, and in the depicted example both sensors are located proximate the suction side of the compressor, e.g., proximate the inlet to the compressor. In some examples, the property being monitored is the saturation temperature of the refrigerant. This is the temperature at which the refrigerant changes from a liquid to a gas, and may vary based on the conditions, e.g., pressure, of the refrigerant fluid. In these examples, the saturation temperature refers to the temperature at which refrigerant fluid in the climate control system turns from a liquid to a gas at the conditioning heat exchanger, e.g., indoor unit 108 in a split system, which may sometimes be referred to as the evaporator heat exchanger in cooling mode. In some examples, the refrigerant fluid is superheated at the conditioning heat exchanger such that the refrigerant fluid temperature is raised above the saturation temperature. In some examples, as discussed below, the temperature monitored by a given sensor may be offset to determine the saturation temperature of the refrigerant fluid.

The depicted example includes a temperature sensor 212 that may monitor the temperature of the refrigerant fluid proximate the inlet to the compressor 204. The temperature of the refrigerant fluid at the inlet to the compressor may be the same, or close to, the temperature of the refrigerant fluid exiting the conditioning heat exchanger, e.g., the indoor heat exchanger 108.

The depicted example includes a pressure sensor 214 that may be used to monitor the pressure of the refrigerant fluid proximate the inlet to the compressor 204. In some examples, the pressure of the refrigerant fluid as a gas exiting the conditioning heat exchanger, e.g., the indoor heat exchanger 108, may provide an indication of the saturation temperature of the refrigerant fluid. Similar to the temperature sensor 212, the pressure of the refrigerant fluid at the inlet to the compressor may be the same, or close to, the pressure of the refrigerant fluid exiting the conditioning heat exchanger. However, the pressure of the refrigerant may be more sensitive to pressure drops based on the distance the pressure is monitored from the conditioning heat exchanger. In these examples, an adjustment may be made for this pressure drop.

In the example depicted in FIG. 2, the outdoor unit 200 also includes control circuitry 216. In the depicted example, the control circuitry is coupled to the various sensors, e.g., the humidity sensor 210, pressure sensor 212, and temperature sensor 214. In some examples, the control circuitry receives signals from these sensors indicative of the measurements received by the sensors. These signals may be in any form, e.g., wired, wireless, etc. In the depicted examples, the control circuitry is further operably coupled to the adjustable compressor 204 and the adjustable fan 206. In some examples, the control circuitry may control the operation of these components, and in some examples, the control circuitry may also receive inputs regarding the performance of the components, e.g., operating speed, power level, etc.

In some examples, the control circuitry 216 configured to control the outdoor unit 200 is further coupled to a thermostat (not-shown). In some of these examples, the thermostat is a non-communicating thermostat that provides limited control information. For example, the thermostat may communicate via a 24V communication protocol, which in some examples, only provides the outdoor unit control circuitry with information regarding whether to operate or not and/or which conditioning mode is requested, e.g., a cooling mode or a heating mode. In these examples, the non-communicating thermostat may not provide any other information regarding the climate control system and/or the desired operation. For example, the non-communicating thermostat may not provide any information regarding the temperature setpoint of a given space to be conditioned, the operating conditions of the indoor unit, e.g., temperature or pressure of the refrigerant fluid in the indoor unit, conditioning air entering or exiting temperature, or any information regarding the outdoor ambient environment. In some examples, the outdoor unit may be coupled to a thermostat that utilizes more advanced communication protocols, e.g., a communicating thermostat, but these communication protocols may be incompatible with the control circuitry controlling the outdoor unit. In these examples, the thermostat may control the outdoor unit in a similar manner to a non-communicating thermostat, e.g., sending control information via a 24V communication protocol or other limited communication protocols. In some examples, the control circuitry configured to control the outdoor unit may include control circuity that improves the operation of the components of the outdoor unit regardless of the information (or lack thereof) provided by a thermostat connected to the outdoor unit control circuitry.

Figure 3:
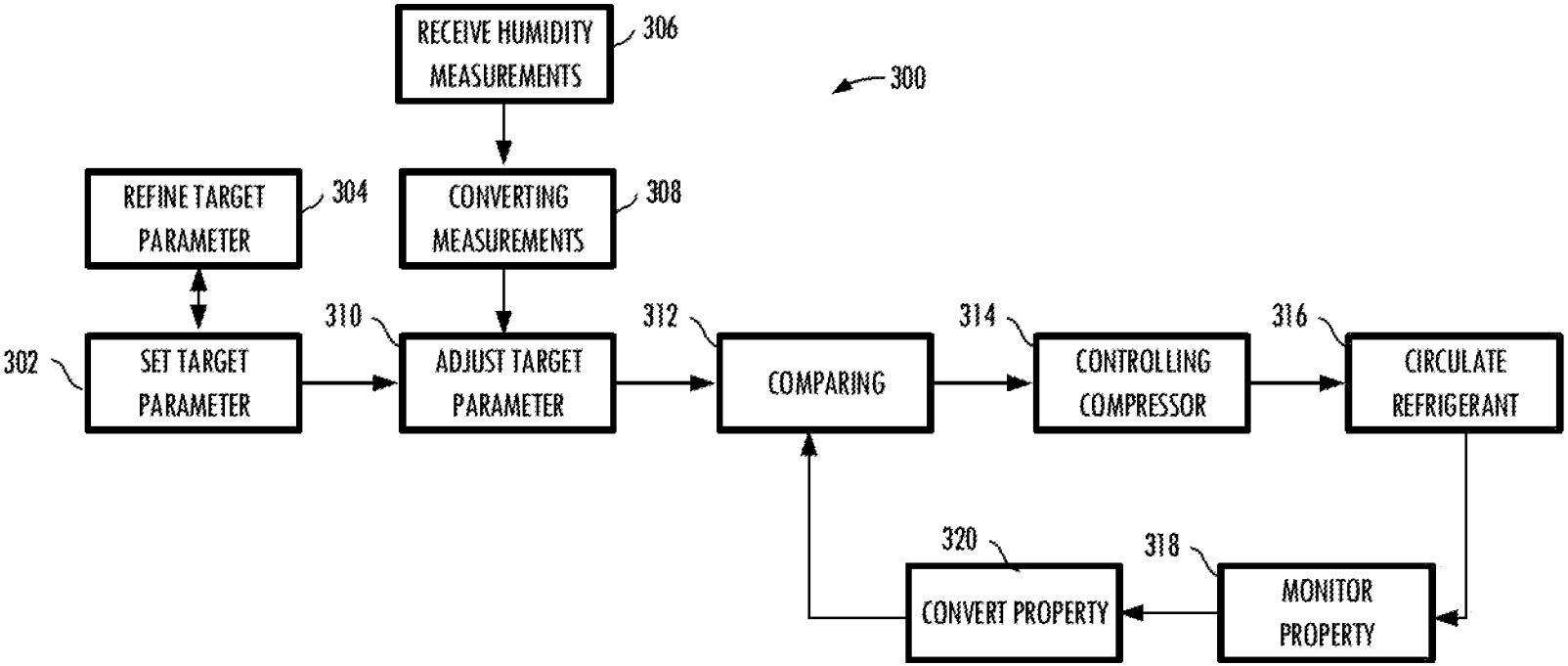
FIG. 3 is a diagram of a process for controlling a climate control system, according to an example embodiment of the present disclosure.

FIG. 3 provides an example diagram of a process 300 for operating a climate control system 100, and in some examples, the control circuitry 216 includes control circuitry for performing process 300. In some examples, this process includes controlling a compressor, potentially an adjustable compressor 204. This process may also include establishing a target parameter for controlling an operation of the adjustable compressor. The target parameter may be associated with a property of a refrigerant fluid circulated within a climate control system. In some examples, the property may be the saturation temperature of the refrigerant fluid. The process may further include receiving a signal indicative of a measurement associated with the humidity condition of the outdoor ambient environment from the humidity sensor, and potentially adjusting the target parameter based on the measurement from the humidity sensor. In these examples, the adjustment may establish an adjusted target parameter. The process may further include monitoring the property of the refrigerant fluid, e.g., the saturation temperature, and comparing the monitored property to the adjusted target parameter. The process may further include adjusting the operation of the adjustable compressor based, at least in part, on the comparison of the monitored property to the adjusted target parameter.

To walk through an example process 300 in more detail, FIG. 3, provides an illustration of potential process steps. For context, in some examples, the climate control system 100 may be controlled based on various parameters. In the depicted example, the target parameter is saturation temperature, but other parameters may be used, e.g., suction pressure. In the depicted example, the control parameter is used to control the adjustable compressor 204, potentially the speed or power level of the compressor. In some examples, the control parameter is used to control additional components of the climate control system 100 such as the fan 206 and/or additional components.

In some examples, the process 300 includes establishing a target parameter for controlling the operation of one or more components, e.g., adjustable compressor 204, of the climate control system 100. The example depicted in FIG. 3 includes process steps that may be used to establish the target parameter, block 302 and 304. In the depicted example, the target parameter may be set at block 302, and in some examples, the target value is further refined through additional inputs as shown in block 304. In some examples, the target parameter is established once the target value is set. In other examples, the target parameter is not established until it has been refined further by additional inputs, and in some examples, it is refined multiple times and based on multiple inputs. Other methods may be used to establish the target parameter.

The process may include multiple approaches for setting the target value as shown in block 302. In some examples, the target parameter may be set as a default setting for the climate control system. In these examples, the initial target parameter may be set to control the performance of the system in a desired fashion, e.g., to minimize energy loss, maximize component life, etc. In some examples, the initial target parameter may be set based on the model of the outdoor unit and/or the compressor. In some examples, the target parameter is based on comparable climate control systems. In some examples, the target parameter is determined based on testing or other factors. In some examples, the target parameter is determined based on calculations, modeling, or other analytical approaches.

In some examples, the target parameter that is set may be refined as shown in block 304. In some examples, this refinement is based on installation settings. For example, the target parameter may be refined based on the size of the indoor unit coupled to the outdoor unit, e.g., it may be changed based on capacity of the fully connected climate control system 100. In some examples, the target parameter may be refined based on the location the outdoor unit 200 is installed. For example, the target parameter may be changed based on the geographical location the outdoor unit is installed, which may indicate general outdoor conditions, e.g., temperatures or humidity. In some examples, this refinement is made manually, potentially by a technician, an installer, a home owner, etc., who may input the information, e.g., a zip code, address or other geographical information. In other examples, the target parameter may be updated automatically. For example, a global positioning system (GPS) locator may be used to determine the location the outdoor unit is installed and that information is used to refine the target parameter. Other methods for refining the default target parameter may be used. In these examples, the established target parameter may be based on the target parameter set at block 302 and refined based on one or more of these factors discussed in connection with block 304.

In some examples, the process 300 may include additional steps for adjusting the target parameter, potentially based on measurements received. In some examples, the measurements associated with a humidity condition of the outdoor environment are used to adjust the target parameter. This process may include the step of receiving the measurements as shown in block 306. The process may further include the step of converting measurements into an offset value as shown in block 308. The process may also adjust the established target parameter based on the offset value to establish an adjusted target parameter. In other examples, the target parameter may be adjusted directly based on the measurements received.

As shown in block 306, the process 300 may receive measurements associated with a humidity condition of the outdoor environment. These measurements may be received in various ways. For example, the measurements may be received by a sensor, potentially the humidity sensor 210 discussed above, or by other sensors. In other examples, the measurements may be received from a connected device or other method.

In some examples, the measurements associated with the humidity condition of the outdoor environment are converted into an offset value as shown in block 308. For example, measurements associated with the humidity condition may provide an indication of the latent load within the space(s) conditioned by the climate control system 100. This indication may be the result of the load associated with the humidity in the outdoor air directed into the space(s), and/or there may be other correlations between outdoor humidity and load. Regardless, in some examples, the process 300 may convert measurements associated with the measured humidity condition of the outdoor ambient environment into a value relevant to the operation of the climate control system. For example, the measurements associated with the humidity condition may be converted to an offset value, which may be used to adjust the target parameter. In these examples, the offset value may be indicative of a difference between the standard load and the actual load at the conditioning heat exchanger caused by the latent load.

In some examples, the offset value is calculated based on an average humidity condition compared to the measured humidity conditions. For example, this value may be determined using the following equation:

$$\text{Offset Value}=k\ (\text{HCs}-\text{HCm})$$

In this example, the offset value is the "Offset Value," "k" is a constant, "HCm" is the measured humidity condition, and "HCs" is the standard or expected measured humidity condition that the system is designed for.

To walk through a further example, the humidity condition may be a dew point. In this example, the typical summer dewpoint for the average location in the United States may be about 63° F., and as a result, the HCs value is 63 in this example. Further, the constant used for this dewpoint correlation may be 0.33. As a result, in this example, the equation may simplify to:

$$\text{Offset Value}=0.33\ (63-\text{HCm})$$

In this example, if the measured dewpoint, e.g., measured at step 306, is 78° F. (e.g. Miami, FL on a humid day), then the offset value determined at step 308 is −5° F. If in another example, the measured dewpoint, e.g., measured at step 306, is 48° F. (e.g. in Phoenix, AZ on a dry day), then the offset value determined at step 308 is +5° F.

In some examples, the correlation between the outdoor environment humidity conditions and the conditioning load is not directly tied, but rather directional. For example, as the humidity in the outdoor ambient environment goes up, the latent load in the conditioning spaces may go up as well. Correspondingly, as the humidity in the outdoor ambient environment goes down, the latent load may go down as well. Again, the process 300 may account for this change by using the measurements associated with the humidity condition of the outdoor environment to determine the offset value, see block 308. In some examples, the offset value may be a positive value, indicating that to account for the latent load change, the target parameter may need to be increased. In other examples, the offset value may be a negative value, indicating that the target parameter may need to be decreased.

In some examples, the adjustment to the target parameter is in the inverse of the change in the measurement associated with the humidity condition. For example, if the humidity conditions the outdoor environment go down, this may indicate that the latent load has gone down as well, which may indicate that the target parameter should go up. As a result, in these examples, the offset value may be a positive value, and in some examples, the greater the humidity goes down the larger the offset value is set in a positive direction. The converse may also be true. If the measurements indicated that the humidity condition is going up in the outdoor ambient environment, which may result in the offset value being a negative value. In these examples, the offset value may be a greater negative value when the humidity goes up a greater amount.

The offset value may be used to adjust the target parameter as shown in block 310. In these examples, the adjusted target parameter may be established by offsetting the target parameter with the offset value. In these examples, if the offset value indicates that the target parameter should be increased, e.g., the offset is a positive value, then the target parameter may be increased by that amount to establish the adjusted target parameter. Conversely, if the offset value indicates that the target parameter should be decreased, e.g., the offset is a negative value, then the target parameter is decreased by that amount to establish the adjusted target parameter.

To use the above example, the target parameter may be established as 53° F. based on step 302 and 304. In the above example where the humidity measurement is 78° F. (e.g. Miami, FL on a humid day) the offset value may be −5° F. as based on step 308. As a result, at step 310, the adjusted target parameter may be established to be 48° F. Similarly, in the above example where the humidity measurement is 48° F. (e.g. Phoenix, AZ on a dry day) the offset value +5° F. as based on step 308. In this example, at step 310, the adjusted target parameter may be established to be 58° F.

As discussed above, other methods may be used including adjusting the target parameter through more complex offsets or scaling factors. In addition, in some examples, the measurements received are used to directly adjust the target parameter without using an offset value.

The process 300 depicted in FIG. 3 further shows an example control loop for the climate control system 100 in blocks 312, 314, 316, 318, and 320. The process may include more or less steps, and in some examples, there is no feedback loop. In the depicted example, this process includes using the adjusted target parameter to control the adjustable compressor 204 of the climate control system. This may include monitoring the property of the refrigerant fluid, where the monitored property is the same property as the target parameter. The process may further include comparing the monitored property to the adjusted target parameter, and the process may further include adjusting the operation of the compressor of the climate control system based on the comparison of the monitored property and the adjusted target parameter.

In some examples, the process 300 may control the adjustable compressor 204 based on the adjusted target parameter. In the depicted example, the control process uses a feedback loop, and controls the compressor based on the difference between a monitored parameter of the climate control system 100 and a given target parameter, e.g., the adjusted target parameter as shown in block 312. At this step, an error value may be determined where the error value is indicative of the difference between the monitored parameter and the adjusted target parameter. In some examples, the error value is indicative of the difference between the actual operation of one or more components of the climate control system and the desired performance of those components. In the depicted example, the error value provides an indication of the difference between the desired operation of the adjustable compressor and the actual operation of the adjustable compressor. In some examples, the control process may use the target parameter, e.g., the adjusted target parameter, directly without any feedback.

In the depicted example, the adjustable compressor 204 may be controlled based on the error value as shown in block 314. This error value may be used to adjust the operation of the adjustable compressor. For example, the process 300 may increase the speed of the adjustable compressor based on this error value at step 314. This may be because the monitored parameter is less than the adjusted target parameter, and as a result, the speed of the compressor may need to be increased. The process may also decrease the speed of the compressor based on this error value in a similar manner. In some examples, the adjustable compressor is a variable speed compressor, and the adjustments change the speed of the compressor using the variable speed drive (VFD). As mentioned previously, the process may control other components in a similar fashion, e.g., indoor fan, outdoor fan, metering device, etc.

In some examples, the adjustable fan 206 may also be controlled as part of the process 300. In these examples, the adjustable fan may be controlled based on the same or a similar process as described above regarding the adjustable compressor 204, e.g., based on an error value associated with the monitored property to the adjusted target parameter. In some examples, the operation of the adjustable fan is linked to the control of the adjustable compressor, e.g., the fan speed is increased when the compress speed is increased and vice versa. The adjustable fan may also be controlled using other processes.

As shown in the depicted example, the compressor will circulate the refrigerant fluid to address a conditioning load as shown at block 316. As discussed above, the climate control system 100 may be operated in various conditioning modes to address a conditioning load. Any of these conditioning modes may be performed at this step 316 in the process 300. As discussed previously, the conditioning load may be addressed at the conditioning heat exchanger, e.g., the indoor heat exchanger 108, in order to condition the air prior to entering a conditioning space(s). In some examples, the climate control system is operated in a cooling mode operation, and in these examples, the refrigerant fluid may be circulated to address both a sensible and latent conditioning load. In other examples, the compressor circulates the refrigerant in a heating mode, or potentially another mode such as defrost.

In the depicted example, one or more properties of the refrigerant may be monitored at block 318. These monitored properties may be used as part of the control process, and potentially compared to the target parameter as shown in block 312 and discussed above. For example, the climate control system may include a pressure sensor 212 and/or a temperature sensor 214, which may monitor the pressure and/or the temperature of the refrigerant fluid, respectively, at a given location. In some examples, the monitoring step 318 monitors the refrigerant fluid proximate the inlet to the compressor. In some examples, as discussed above, the properties of the refrigerant fluid proximate the inlet to the compressor are indicative of the properties of the refrigerant fluid as it exits the conditioning heat exchanger, e.g., the indoor heat exchanger 108. In some examples, the monitored property needs to be adjusted to account for the specific location being monitored, e.g., accounting for pressure drop based on distance a pressure sensor is located from the conditioning heat exchanger.

In some examples, the process 300 may further include converting the monitored property to a different form at step 320. This process step may be used in examples where the monitored property is different from the target parameter, and in these examples, the monitored property may be converted to a form that allows the monitored property to be compared to the target parameter at step 312. For example, the monitored property may be a pressure of the refrigerant fluid exiting the conditioning heat exchanger and the target parameter may be a temperature value, or potentially a saturation temperature value. In these examples, the monitored refrigerant pressure may be converted to a temperature value. In some examples, the conversion between monitored pressure and saturation temperature is based on thermodynamic equations and the property of the refrigerant. In some examples the conversion is based on look-up tables or equations. Other conversion methods may also be used. In addition, in some examples, the conversion of the monitored pressure to a saturation temperature may include an offset for pressure loss of refrigerant based on the location the pressure is monitored at. In some examples, the conversion further includes an offset for any desired or set superheat for the refrigerant. Other conversion methods may also be used so that an effective comparison may be made between the monitored refrigerant conditions and the desired conditions as set by the target parameters.

In some examples, the process 300 then returns to process step 312, and at that step, the process may compare the monitored property with the adjusted target parameter. In some examples the monitored property is a converted monitored property using the conversion process at step 320.

In some examples, the process 300 is repeated multiple times. For example, the process control loop 312, 314, 316, 318, and potentially 320, if applicable, may be continuously repeated during a conditioning cycle to control the operation of the compressor (or other components) and address the conditioning load. In some examples, the target parameter may also be adjusted. In these examples, the target parameter may be adjusted based on changes to the outdoor ambient environment, which may allow the climate control system to better account for any changes in latent load being conditioned by the system. In these examples, the process step of receiving the measurement representative of the humidity condition of the outdoor ambient environment, step 306, may include receiving one or more updated measurements representative of the humidity condition of the outdoor ambient environment. In these examples, each of the one or more updated measurements may be received at a regular time interval, and each of the updated measurements may be representative of the humidity condition of the outdoor ambient environment at a given time. For example, the process may include taking humidity measurements on a regular schedule, e.g., a regular time interval. At each time interval a humidity measurement is taken and that measurement is indicative of the humidity conditions at that time. In some examples, the regular time interval is very short such that that humidity measurements are taken on a continuous basis.

In these examples, establishing an adjusted target parameter 310 may also include periodically adjusting the target parameter based on one or more of the updated measurements. In some examples, the target parameter may be adjusted continuously, on regular intervals, or other processes, which may allow the climate control system to regularly update the control operations. For example, the target parameter may be adjusted each time a conditioning call is made, and in other examples, the target parameter is adjusted based on a schedule, e.g., daily, hourly, etc. In some examples, the target parameter is adjusted each time an updated measurement is received. This updated, adjusted target parameter may be used as part of the process control loop that may include process steps 312, 314, 316, 318, 320, etc.

As discussed above, the target parameter value may be various different values, and thus the adjustment value may be similarly varied to account for both how the target parameter value is being used to control the system and how the humidity measurement would impact this control process. However, to walk through an example, the target parameter value may be saturation temperature. In these examples, the process 300 may be used to set a target saturation temperature as the target parameter. At step 302, the default target property may be set as a given target saturation temperature, e.g., 50° F., based on the model of the outdoor unit being controlled. At step 304, the default target property may be revised based on the relative size of the indoor unit connected to the outdoor unit at issue. For example, if a larger indoor unit relative to the nominal match for the given outdoor unit is connected, then the default target saturation temperature may be increased by a certain amount, e.g., 1° F. to 2° F. In this example, the default target property is not revised based on geographic location, however, in other examples geographic location may be another factor that may cause the process to revise the default target property. Once the default target parameter has been revised based on the installation specific information, which in this example is the capacity of the indoor unit, the target parameter for the climate control system in this example is established.

In this example, the outdoor unit 200 further includes a humidity sensor 210, which in this example monitors the dewpoint of the outdoor ambient environment. In this example, the control circuitry 216 receives measurements from the humidity sensor indicative of the humidity condition of the outdoor ambient environment at step 306. The humidity measurements are then converted into an offset value at step 308. In this example, the offset value is based on the difference between the standard humidity conditions assumed based on the default target parameter and the measured humidity conditions. In particular, the offset value is a change in the target saturation temperature based on the measured humidity condition. Thus, in this example, if the measured humidity is greater than the standard humidity condition assumed by the default target parameter, then the offset value is a negative value. The value is a negative value in order to drive the compressor at a higher level to address the higher latent load indicated by the humidity measurement. In this example, if the measured humidity is less than the standard humidity condition assumed by the default target parameter then the offset value is a positive value, which may result in driving the compressor at a lower level.

In this example, the climate control system 100 adjusts the target parameter to create an adjusted target parameter at step 310. In this example, the target parameter established at step 302 is adjusted based on the offset value determined at step 308. For example, the target parameter in this example is set at a given value, e.g., 51° F., based on refinements made to the default target parameter. The measured humidity condition in this example is a dewpoint of 78° F. measured at step 306. At step 308, this measured dewpoint is converted to an offset value, and in this example, the above equation is used, e.g., the standard dewpoint for the climate control system in this example is 63° F. and the offset constant is 0.33. Thus, the offset value is determined to be −5° F. In this example, the target parameter from step 302 is combined with the offset value from 308 to create the adjusted target parameter, e.g., 46° F.

In this example, the control circuitry 216 controls the adjustable compressor 204 based on the adjusted target temperature, e.g., the target saturation temperature as adjusted. At step 312, the process 300 may determine the difference between the monitored conditions and the adjusted target parameter. In this example, the difference between these values is used to control the operation of the compressor at step 314. In other examples, where the monitored saturation temperature is greater than the target saturation temperature the difference determined at step 312 indicates the compressor speed should be increased. In other examples, the monitored temperature may be less than the target saturation temperature and the compressor speed is decreased.

In these examples, the adjustable compressor 204 circulates the refrigerant fluid through the climate control system 100 to address the conditioning load at step 316. At step 318 of process 300, the control circuitry 216 monitors the pressure of the refrigerant as it exits the conditioning heat exchanger, e.g., the indoor heat exchanger 108, using a pressure sensor 212. In this example, the pressure sensor is located in the outdoor unit proximate the suction side of the adjustable compressor, which is located a distance away from the conditioning heat exchanger. In this example, the process includes a step 320 where the monitored pressure is converted into a monitored saturation temperature. As part of this process, the monitored pressure is adjusted to account for the pressure loss based on the distance the pressure sensor is located from the conditioning heat exchanger. The monitored pressure is then converted to a saturation temperature using a look-up table or an equation. Once converted, the monitored saturation temperature, as determined by the monitored pressure, is compared with the adjusted target saturation temperature parameter at step 312 to repeat the process.

FIGS. 4A, 4B, 4C, 4D, 4E, 4F, 4G, and 4H are flowcharts illustrating various steps in a method 400 of controlling an adjustable compressor 204 in the climate control system 100. The method may include establishing a target parameter for controlling an operation of the adjustable compressor, as shown in block 402 of FIG. 4A, and the target parameter may be associated with a property of a refrigerant fluid circulated within a climate control system. The method may also include receiving a measurement representative of a humidity condition of an outdoor ambient environment, as shown in block 404. The method may further include adjusting the target parameter based on the measurement associated with the humidity condition, and these adjustments may establish an adjusted target parameter, as shown in block 406. The method may also include monitoring the property of the refrigerant fluid, as shown in block 408. In some examples, the method includes comparing the monitored property to the adjusted target parameter, as shown in block 410. The method may also include adjusting an operation of the adjustable compressor based, at least in part, on the comparison of the monitored property to the adjusted target parameter, as shown in block 412.

In some examples, adjusting operation of the adjustable compressor in the method 400 includes adjusting the speed of the adjustable compressor as shown in block 414 of FIG. 4B. In some examples, the method 400 further includes adjusting the operation of an adjustable fan based, at least in part, on at least one of the adjustment of the operation of the adjustable compressor or the comparison of the monitored property to the adjusted target parameter, as shown in block 416 of FIG. 4C.

In some examples, receiving the measurement of the humidity condition in the method 400 includes receiving a signal indicative of the measurement associated with the humidity condition from a humidity sensor located on an outdoor unit of the climate control system, as shown in block 418 of FIG. 4D.

In some examples, the method 400 further includes adjusting the target parameter based on installation settings, as shown in block 420 of FIG. 4E.

In some examples, receiving the measurement representative of the humidity condition in method 400 includes receiving one or more updated measurements representative of the humidity condition of the outdoor ambient environment, as shown in block 422 of FIG. 4F. In these examples, each of the one or more updated measurements may be received at a regular time interval, and they each may be representative of the humidity condition of the outdoor ambient environment at a given time. Adjusting the target parameter in the method may also include periodically adjusting the target parameter based on one or more of the updated measurements, the periodic adjustment establishing the adjusted target parameter, as shown in block 424.

In some examples, adjusting the target parameter in the method 400 further includes adjusting the target parameter inverse to a change in the measurement associated with the humidity condition, as shown in block 426 of FIG. 4G.

In some examples, the method 400 further includes receiving a request for cooling mode at the outdoor unit from a non-communicating thermostat via the 24V communication protocol, as shown in block 428 of FIG. 4H. These examples may also include operating the outdoor unit in the cooling mode in response to the request, as shown in block 430.

FIG. 5 illustrates the control circuitry 216 according to some example embodiments of the present disclosure. In some examples the control circuit includes some or all of the system controller 106, the indoor controller 124, and the outdoor controller 126. In some examples, the control circuitry may include one or more of each of a number of components such as, for example, a processor 502 connected to a memory 504. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor 502 may be a number of processors, a multi-core processor or some other type of processor, depending on the particular embodiment.

The processor 502 may be configured to execute computer programs such as computer-readable program code 506, which may be stored onboard the processor or otherwise stored in the memory 504. In some examples, the processor may be embodied as or otherwise include one or more ASICs, FPGAs or the like. Thus, although the processor may be capable of executing a computer program to perform one or more functions, the processor of various examples may be capable of performing one or more functions without the aid of a computer program.

The memory 504 is generally any piece of computer hardware capable of storing information such as, for example, data, computer-readable program code 506 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 502, causes the control circuitry 216 to perform various operations as described herein, some of which may in turn cause the HVAC system to perform various operations.

In addition to the memory 504, the processor 502 may also be connected to one or more peripherals such as a network adapter 508, one or more input/output (I/O) devices 510 or the like. The network adapter is a hardware component configured to connect the control circuitry 216 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

As explained above and reiterated below, the present disclosure includes, without limitation, the following example implementations.

Clause 1. A method for controlling an adjustable compressor within a climate control system, the method comprising: establishing a target parameter for controlling an operation of the adjustable compressor, the target parameter associated with a property of a refrigerant fluid circulated within a climate control system; receiving a measurement representative of a humidity condition of an outdoor ambient environment; adjusting the target parameter based on the measurement, the adjustment establishing an adjusted target parameter, monitoring the property of the refrigerant fluid; comparing the monitored property to the adjusted target parameter; and adjusting an operation of the adjustable compressor based, at least in part, on the comparison of the monitored property to the adjusted target parameter.

Clause 2. The method in any of the preceding clauses, wherein the adjustable compressor is one of either a variable speed compressor or a variable capacity compressor, and adjusting the operation of the adjustable compressor includes adjusting a speed of the adjustable compressor.

Clause 3. The method in any of the preceding clauses, further comprising adjusting the operation of an adjustable fan based, at least in part, on at least one of the adjustment of the operation of the adjustable compressor or the comparison of the monitored property to the adjusted target parameter.

Clause 4. The method in any of the preceding clauses, wherein the property of the refrigerant fluid is a pressure of the refrigerant fluid proximate an inlet to the adjustable compressor.

Clause 5. The method in any of the preceding clauses, wherein the property of the refrigerant fluid is a saturation temperature of the refrigerant fluid.

Clause 6. The method in any of the preceding clauses, wherein receiving the measurement of the humidity condition includes receiving a signal indicative of the measurement associated with the humidity condition from a humidity sensor located on an outdoor unit of the climate control system.

Clause 7. The method in any of the preceding clauses, wherein the humidity condition is one of either a dew point of the outdoor ambient environment or a humidity ratio of the outdoor ambient environment.

Clause 8. The method in any of the preceding clauses, wherein the target parameter is a default setting for the climate control system.

Clause 9. The method in any of the preceding clauses, further comprising refining the target parameter based on installation settings.

Clause 10. The method in any of the preceding clauses, wherein receiving the measurement representative of the humidity condition includes receiving one or more updated measurements representative of the humidity condition of the outdoor ambient environment, each of the one or more updated measurements being received at a regular time interval and representative of the humidity condition of the outdoor ambient environment at a given time, and wherein adjusting the target parameter includes periodically adjusting the target parameter based on one or more of the updated measurements, the periodic adjustment establishing the adjusted target parameter.

Clause 11. The method in any of the preceding clauses, wherein adjusting the target parameter further includes adjusting the target parameter inverse to a change in the measurement associated with the humidity condition.

Clause 12. The method in any of the preceding clauses, wherein the climate control system further includes an outdoor unit coupled to a non-communicating thermostat via a 24 volt (24V) communication protocol, and the method further comprises: receiving a request for a cooling mode at the outdoor unit from the non-communicating thermostat via the 24V communication protocol, and operating the outdoor unit in the cooling mode in response to the request.

Clause 13. An outdoor unit of a climate control system, the outdoor unit comprising: a housing; an adjustable compressor located within the housing and configured to circulate a refrigerant fluid through the climate control system; a humidity sensor configured to detect a measurement representative of a humidity condition of an outdoor ambient environment; and control circuitry operably coupled to the adjustable compressor and configured to: establish a target parameter for controlling an operation of the adjustable compressor, the target parameter associated with a property of a refrigerant fluid circulated within a climate control system; receive a signal indicative of the measurement associated with the humidity condition of the outdoor ambient environment from the humidity sensor; adjust the target parameter based on the measurement, the adjustment establishing an adjusted target parameter, monitor the property of the refrigerant fluid; compare the monitored property to the adjusted target parameter; and adjust an operation of the adjustable compressor based, at least in part, on the comparison of the monitored property to the adjusted target parameter.

Clause 14. The outdoor unit in any of the preceding clauses, wherein the adjustable compressor is one of either a variable speed compressor or a variable capacity compressor, and the control circuitry that adjusts the operation of the adjustable compressor further includes control circuitry that adjusts a speed of the adjustable compressor.

Clause 15. The outdoor unit in any of the preceding clauses, further comprising an adjustable fan, and wherein the control circuitry is further operably coupled to the adjustable fan and further configured to adjust an operation of the adjustable fan based, at least in part, on at least one of the adjustment of the operation of the adjustable compressor or the comparison of the monitored property to the adjusted target parameter.

Clause 16. The outdoor unit in any of the preceding clauses, wherein the property of the refrigerant fluid is a pressure of the refrigerant fluid proximate an inlet to the adjustable compressor.

Clause 17. The outdoor unit in any of the preceding clauses, wherein the property of the refrigerant fluid is a saturation temperature of the refrigerant fluid.

Clause 18. The outdoor unit in any of the preceding clauses, wherein the target parameter is a default setting for the climate control system.

Clause 19. The outdoor unit in any of the preceding clauses, wherein the target parameter is a default setting for the climate control system.

Clause 20. The outdoor unit in any of the preceding clauses, wherein the control circuitry is further configured to refine the target parameter based on installation settings.

Clause 21. The outdoor unit in any of the preceding clauses, wherein the control circuitry configured to receive the signal indicative of the measurement associated with the humidity condition further includes control circuitry configured to receive one or more signals indicative of one or more updated measurements representative of the humidity condition of the outdoor ambient environment, each signal representative of each updated measurement being received at a regular time interval and representative of the humidity condition of the outdoor ambient environment at a given time, and the control circuitry configured to adjust the target parameter further includes control circuitry configured to periodically adjust the target parameter based on one or more of the updated measurements, the periodic adjustment establishing the adjusted target parameter.

Clause 22. The outdoor unit in any of the preceding clauses, wherein the control circuitry configured to adjust the target parameter further includes control circuitry to adjust the target parameter inverse to a change in the measurement associated with the humidity condition.

Clause 23. The outdoor unit in any of the preceding clauses, wherein the control circuitry is further coupled to a non-communicating thermostat via a 24 volt (24V) communication protocol, and the control circuity is further configured to: receive a request for a cooling mode from the non-communicating thermostat via the 24V communication protocol, and operate the outdoor unit in the cooling mode in response to the request.

Clause 24. A climate control system comprising: an outdoor unit including: a housing, an adjustable compressor located within the housing and configured to circulate a refrigerant fluid through the climate control system, a humidity sensor located within the housing and configured to detect a measurement representative of a humidity condition of an outdoor ambient environment, a pressure sensor coupled to the housing and configured to detect a pressure representative of the refrigerant fluid proximate an inlet to the adjustable compressor, and control circuitry located within the housing and coupled to the adjustable compressor, the humidity sensor, and the pressure sensor; and a non-communicating thermostat located outside the housing and associated with a conditioned space, wherein the control circuitry is further coupled to the non-communicating thermostat via a 24 volt (24V) communication protocol and configured to: receive a request for a cooling mode from the non-communicating thermostat via the 24V communication protocol; operate the outdoor unit in the cooling mode in response to the request; establish a target parameter for controlling an operation of the adjustable compressor, the target parameter associated with the temperature of the refrigerant fluid circulated within the climate control system; receive a signal indicative of the measurement associated with the humidity condition of the outdoor ambient environment from the humidity sensor; adjust the target parameter based on the measurement, the adjustment establishing an adjusted target parameter, monitor the temperature of the refrigerant fluid proximate the inlet to the adjustable compressor using the measurements received from the pressure sensor, compare the monitored temperature to the adjusted target parameter, and adjust an operation of the adjustable compressor based, at least in part, on the comparison of the monitored temperature to the adjusted target parameter.

Many modifications and other embodiments of the disclosure set forth herein will come to mind to one skilled in the art to which the disclosure pertains having the benefit of the teachings presented in the foregoing description and the associated figures. Therefore, it is to be understood that the disclosure is not to be limited to the specific embodiments disclosed and that modifications and other embodiments are intended to be included within the scope of the appended claims. Moreover, although the foregoing description and the associated figures describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A method for controlling an adjustable compressor within a climate control system, the method comprising:

establishing a target parameter for controlling an operation of the adjustable compressor, the target parameter associated with a property of a refrigerant fluid circulated within the climate control system;

receiving a measurement representative of a humidity condition of an outdoor ambient environment;

converting the measurement representative of the humidity condition to an offset value, the offset value indicative of a latent cooling load associated with an indoor space conditioned by the climate control system;

adjusting the target parameter based on the offset value, the adjustment establishing an adjusted target parameter, monitoring the property of the refrigerant fluid;

comparing the monitored property to the adjusted target parameter; and adjusting an operation of the adjustable compressor based, at least in part, on the comparison of the monitored property to the adjusted target parameter.

2. The method of claim 1, wherein the adjustable compressor is one of either a variable speed compressor or a variable capacity compressor, and adjusting the operation of the adjustable compressor includes adjusting a speed of the adjustable compressor.

3. The method of claim 1, further comprising adjusting the operation of an adjustable fan based, at least in part, on at least one of the adjustment of the operation of the adjustable compressor or the comparison of the monitored property to the adjusted target parameter.

4. The method of claim 1, wherein the property of the refrigerant fluid is a pressure of the refrigerant fluid proximate an inlet to the adjustable compressor.

5. The method of claim 1, wherein the property of the refrigerant fluid is a saturation temperature of the refrigerant fluid.

6. The method of claim 1, wherein receiving the measurement of the humidity condition includes receiving a signal indicative of the measurement associated with the humidity condition from a humidity sensor located on an outdoor unit of the climate control system.

7. The method of claim 1, wherein the humidity condition is one of either a dew point of the outdoor ambient environment or a humidity ratio of the outdoor ambient environment.

8. The method of claim 1, wherein the target parameter is a default setting for the climate control system.

9. The method of claim 1, further comprising refining the target parameter based on installation settings.

10. The method of claim 1, wherein receiving the measurement representative of the humidity condition includes receiving one or more updated measurements representative of the humidity condition of the outdoor ambient environment, each of the one or more updated measurements being received at a regular time interval and representative of the humidity condition of the outdoor ambient environment at a given time, and wherein adjusting the target parameter includes periodically adjusting the target parameter based on one or more of the updated measurements, the periodic adjustment establishing the adjusted target parameter.

11. The method of claim 1, wherein adjusting the target parameter further includes adjusting the target parameter inverse to a change in the measurement associated with the humidity condition.

12. The method of claim 1, wherein the climate control system further includes an outdoor unit coupled to a non-communicating thermostat via a 24 volt (24V) communication protocol, and the method further comprises:

receiving a request for a cooling mode at the outdoor unit from the non-communicating thermostat via the 24V communication protocol, and operating the outdoor unit in the cooling mode in response to the request.

13. An outdoor unit of a climate control system, the outdoor unit comprising:

a housing;

an adjustable compressor located within the housing and configured to circulate a refrigerant fluid through the climate control system;

a humidity sensor configured to detect a measurement representative of a humidity condition of an outdoor ambient environment; and control circuitry operably coupled to the adjustable compressor and configured to:

establish a target parameter for controlling an operation of the adjustable compressor, the target parameter associated with a property of a refrigerant fluid circulated within the climate control system;

receive a signal indicative of the measurement associated with the humidity condition of the outdoor ambient environment from the humidity sensor;

convert the measurement representative of the humidity condition to an offset value, the offset value indicative of a latent cooling load associated with an indoor space conditioned by the climate control system;

adjust the target parameter based on the offset value, the adjustment establishing an adjusted target parameter, monitor the property of the refrigerant fluid;

compare the monitored property to the adjusted target parameter; and adjust an operation of the adjustable compressor based, at least in part, on the comparison of the monitored property to the adjusted target parameter.

14. The outdoor unit of claim 13, wherein the adjustable compressor is one of either a variable speed compressor or a variable capacity compressor, and the control circuitry that adjusts the operation of the adjustable compressor further includes control circuitry that adjusts a speed of the adjustable compressor.

15. The outdoor unit of claim 13, further comprising an adjustable fan, and wherein the control circuitry is further operably coupled to the adjustable fan and further configured to adjust an operation of the adjustable fan based, at least in part, on at least one of the adjustment of the operation of the adjustable compressor or the comparison of the monitored property to the adjusted target parameter.

16. The outdoor unit of claim 13, wherein the property of the refrigerant fluid is a pressure of the refrigerant fluid proximate an inlet to the adjustable compressor.

17. The outdoor unit of claim 13, wherein the property of the refrigerant fluid is a saturation temperature of the refrigerant fluid.

18. The outdoor unit of claim 13, wherein the humidity condition is one of either a dew point of the outdoor ambient environment or a humidity ratio of the outdoor ambient environment.

19. The outdoor unit of claim 13, wherein the target parameter is a default setting for the climate control system.

20. The outdoor unit of claim 13, wherein the control circuitry is further configured to refine the target parameter based on installation settings.

21. The outdoor unit of claim 13, wherein the control circuitry configured to receive the signal indicative of the measurement associated with the humidity condition further includes control circuitry configured to receive one or more signals indicative of one or more updated measurements representative of the humidity condition of the outdoor ambient environment, each signal representative of each updated measurement being received at a regular time interval and representative of the humidity condition of the outdoor ambient environment at a given time, and the control circuitry configured to adjust the target parameter further includes control circuitry configured to periodically adjust the target parameter based on one or more of the updated measurements, the periodic adjustment establishing the adjusted target parameter.

22. The outdoor unit of claim 13, wherein the control circuitry configured to adjust the target parameter further includes control circuitry to adjust the target parameter inverse to a change in the measurement associated with the humidity condition.

23. The outdoor unit of claim 13, wherein the control circuitry is further coupled to a non-communicating thermostat via a 24 volt (24V) communication protocol, and the control circuity is further configured to:

receive a request for a cooling mode from the non-communicating thermostat via the 24V communication protocol, and operate the outdoor unit in the cooling mode in response to the request.

24. A climate control system comprising:

an outdoor unit including:

a housing, an adjustable compressor located within the housing and configured to circulate a refrigerant fluid through the climate control system, a humidity sensor located within the housing and configured to detect a measurement representative of a humidity condition of an outdoor ambient environment, a pressure sensor coupled to the housing and configured to detect a pressure representative of the refrigerant fluid proximate an inlet to the adjustable compressor, and control circuitry located within the housing and coupled to the adjustable compressor, the humidity sensor, and the pressure sensor; and a non-communicating thermostat located outside the housing and associated with a conditioned space, wherein the control circuitry is further coupled to the non-communicating thermostat via a 24 volt (24V) communication protocol and configured to:

receive a request for a cooling mode from the non-communicating thermostat via the 24V communication protocol;

operate the outdoor unit in the cooling mode in response to the request;

establish a target parameter for controlling an operation of the adjustable compressor, the target parameter associated with the temperature of the refrigerant fluid circulated within the climate control system;

receive a signal indicative of the measurement associated with the humidity condition of the outdoor ambient environment from the humidity sensor;

convert the measurement representative of the humidity condition to an offset value, the offset value indicative of a latent cooling load associated with an indoor space conditioned by the climate control system;

adjust the target parameter based on the offset value, the adjustment establishing an adjusted target parameter, monitor the temperature of the refrigerant fluid proximate the inlet to the adjustable compressor using the measurements received from the pressure sensor, compare the monitored temperature to the adjusted target parameter, and adjust an operation of the adjustable compressor based, at least in part, on the comparison of the monitored temperature to the adjusted target parameter.

* * * * *